United States Patent [19]

Vives

[11] 4,319,938

[45] Mar. 16, 1982

[54] METHOD OF BUTT-JOINTING METAL TAPES COATED WITH A THERMOPLASTIC POLYMER FILM

[75] Inventor: Jean-Patrick Vives, Calais, France

[73] Assignee: Societe Anonyme dite: Les Cables de Lyons, Lyon, France

[21] Appl. No.: 186,024

[22] PCT Filed: May 10, 1979

[86] PCT No.: PCT/FR79/00042

§ 371 Date: Jan. 10, 1980

§ 102(e) Date: Jan. 10, 1980

[87] PCT Pub. No.: WO79/01048

PCT Pub. Date: Nov. 29, 1979

[30] Foreign Application Priority Data

May 10, 1978 [FR] France ..... 78 13829

[51] Int. Cl.[3] ..... G03D 15/04

[52] U.S. Cl. ..... 156/49; 156/51; 156/159; 156/266; 156/289; 156/304.5; 156/304.6; 156/308.2; 156/581; 156/583.1; 156/668; 156/344; 228/171; 228/203

[58] Field of Search ..... 156/49, 53, 83, 157–159, 156/304.1, 304.5, 304.6, 308.2, 581, 583.1, 289, 266, 51, 344, 668; 260/32.8 A, 32.8 EP, 33.6 PQ; 228/171, 203

[56] References Cited

U.S. PATENT DOCUMENTS

| | | | |
|---|---|---|---|
| 2,628,172 | 2/1953 | Jenett | 260/328 A |
| 2,868,767 | 1/1959 | Cyba et al. | 260/32.8 EP |
| 3,022,194 | 2/1962 | Vollmer | 260/33.6 PQ |
| 3,239,909 | 3/1966 | Shaffer et al. | 29/33 R |
| 3,335,088 | 8/1967 | Mandell | 156/344 |
| 3,421,676 | 1/1969 | Jenkins | 228/171 |
| 4,071,388 | 1/1978 | Usai et al. | 156/304.6 |
| 4,135,957 | 1/1979 | Voller | 156/581 |
| 4,257,820 | 3/1979 | Jacobs | 156/344 |

FOREIGN PATENT DOCUMENTS

| | | | |
|---|---|---|---|
| 2355362 | 1/1978 | France . | |
| 1195164 | 6/1970 | United Kingdom | 156/344 |

*Primary Examiner*—Jerome W. Massie

*Attorney, Agent, or Firm*—Sughrue, Mion, Zinn, Macpeak and Seas

[57] ABSTRACT

A method of butt-joining metal tapes coated on one or both sides with a film of thermoplastic polymer material.

The film is detached from an end portion of each tape (1A 1B) by immersion in a solvent at its boiling point. The detached film is removed and the ends of the two tapes welded together. A film (17, 18) of high-density polyethylene and ionomer resin is applied to the stripped area and bonded thereto by the application of heat and pressure. Device for implementation of the method.

11 Claims, 9 Drawing Figures

METHOD OF BUTT-JOINTING METAL TAPES COATED WITH A THERMOPLASTIC POLYMER FILM

The present invention concerns a method of butt-jointing metal tapes coated on one or both sides with a film of thermoplastic polymer material, as part of a process for manufacturing a composite product involving the continuous feeding of a tape of the metal coated with the thermoplastic polymer film. The problem of butt-jointing two tapes of this type arises in the manufacture of electrical cables comprising an axial conductor, a thick electrical insulator extruded over the conductor and an outer conductor or metal screen applied over the electrical insulator and in turn covered with an outer sheath of thermoplastic polymer material. The problem is of particular importance with regard to submarine telecommunications cables. The present invention is also concerned with a device for carrying out this method, providing a means of rapidly restoring the thermoplastic polymer film stripped away from the end sections of the tapes.

French Pat. Nos. 1 599 919 (Compagnie Generale d'Electricite) and 2 219 498 (the present applicant) refer to cables with a central load-carrying strand of steel wires covered with a copper tube constituting the axial conductor, in turn covered with polyethylene insulation, in turn covered by an outer conductor or screen comprising a tape of aluminium or another good electrical conductor folded around the insulation, at least one side of the tape being previously coated with a film of thermoplastic polymer material. The entire assembly receives an outer jacket of thermoplastic polymer material. The internal and/or external coating films on the outer conductor or screen are bonded to the insulation and the outer sheath, respectively.

This type of cable is commonly known to those skilled in the art as a "compact cable", and one design objective for this type of cable is to obtain a strong bond between the outer conductor or screen and the insulation and/or the outer sheath. The excellent mechanical properties of this type of cable mean that the thickness of the outer conductor or screen can be reduced to a value consistent with the maximum permissible attenuation per unit length. The thickness of the outer sheath may also be reduced.

Manufacturing continuous lengths of coaxial cable involves using a device storing a quantity of the tape from which the outer conductor or screen is made. As a general rule, the shaping of the tube for the outer conductor or screen and the extrusion of the outer sheath are carried out simultaneously. The tape is generally supplied on spools, and the unit length supplied is less than the unit cable length, which means that with the cable making machine running normally it is necessary to splice the end of a new spool to the end of the tape on the spent spool. This operation is commonly referred to as "butt-jointing". The butt-jointing of the tapes must be carried out with the machine in operation, as it is not possible to stop extruding the outer sheath and then resume operation without producing discontinuities inconsistent with the required quality of cable.

A device known as an "accumulator" is used to create a reserve of tape, by reeving the tape to form a number of loops. The accumulator is located between the feed spool and the tube-forming unit. This means that tape feed may be interrupted for the time taken to make the butt-joint without stopping the rest of the machine. Generally speaking, the accumulator holds a reserve of a few hundred meters of tape, the tube forming and extrusion operations proceeding at a rate of around ten meters per minute. This means that several tens of minutes are available for the butt-jointing to be carried out.

In the specific case of compact cables, to avoid local loss of the high mechanical strength of the conductor it is necessary to butt-joint the tape without deterioration in its adhesive qualities and without interrupting its electrical continuity. The latter requirement means that the butt-jointing of the metal proper must be carried out using hot welding, cold pressure welding, brazing or bonding using a conductive adhesive.

None of these methods is compatible with the presence of the film of adherent plastics material, which must therefore be removed in the vicinity of the weld. Known methods for removing this film are extremely lengthy, calling for further increase in the capacity of the accumulator. This is extremely difficult from the technical point of view, as in practice it can only be achieved by raising the number of reevings, accentuating the problem of guiding around each return roller a metal tape which in this specific instance is extremely thin, often bowed (one edge being subjected to a higher internal stress than the other), and already (in the usual type of accumulator) subjected to a tensile force approaching the tensile strength of the material from which it is made.

A similar problem arises whenever it is necessary to butt-joint the ends of two metal tapes coated on one or both sides with a film of thermoplastic polymer material, whatever the subsequent application of the metal tape thus jointed, if the properties of the jointed tapes must be maintained.

The method according to the invention is characterised in that it comprises the following steps:

(a) the ends of the two tapes are cut at a predetermined angle to the feed direction;

(b) the thermoplastic polymer film is detached from an end portion of each tape by immersion for a time interval just sufficient to detach the film in a solvent maintained at its boiling point;

(c) the detached thermoplastic polymer film is stripped off;

(d) the end portions of the two tapes are welded together;

(e) at least the stipped end portions of the two tapes are covered with a polymer film which can be bonded to the tapes by the application of heat, the portions of the tapes so covered being placed between two metal plates which have at least their surface in contact with the thermoplastic film coated with a heat-resistant material to which the film will not adhere;

(f) the metal plates are placed between heated press plates and compressed to a high pressure;

(g) the press plates are rapidly cooled and moved apart to enable the metal plates to be removed.

The invention preferably comprises at least one of the following features:

the predetermined angle to the feed direction at which the ends of the two tapes are cut is between 45° and 60°;

for a tape coated with a hybrid film of ionomer polymer for bonding to the metal and high-density polyethylene, the solvent is selected from the group comprising tetrahydronaphthalene, decahydronaphthalene, cyclohexane, cyclohexanone and trichlorethylene;

the solvent is cyclohexanone, and the ends of the tapes are immersed twice, initially for approximately 25 seconds and subsequently for approximately 35 seconds, the two immersions preferably being separated by a wiping stage;

the solvent is decahydronaphthalene, and the tape end portions are immersed three times in succession, for approximately 15 seconds on each occasion;

the thermoplastic polymer film is stripped off so that the edge of the remaining film is at an angle of between 45° and 90° to the feed direction, the portion removed preferably being limited by a bar clamped across the tape at the aforementioned angle;

for a tape coated with a film of low-density polyethylene bonded to the metal, the solvent is selected from the group comprising dimethylformamide and 2-butanone, the tape end portions being immersed for a period which is preferably approximately five seconds;

the material which will not bond to the thermoplastic polymer film and which is placed between the metal plate and the hybrid film of high-density polyethylene and ionomer polymer is polytetrafluorethylene;

the length of the heated press plate applied to the hybrid film and the end portions of the welded tapes is approximately equal to the total stripped length of tape, terminating at each end in a heated section which is spaced from the material which will not bond to the film by a distance which is approximately equal to one-fifth of the thickness of the film;

the press plates are compressed to a load of a few tonnes and their temperature is maintained at approximately 150° C. for a period of one to two minutes before they are rapidly cooled;

a device for applying a polyethylene film to a stripped section of metal tape preferably comprises at least one thin flexible metal plate with a non-stick coating on the side directed towards the polyethylene film, two metal plates equipped with high-speed heating and cooling means arranged on opposite sides of the metal tape, their lengths being substantially equal to the length of the stripped section, and a press capable of urging the polyethylene film into contact with the stripped section of the metal tapes under a high pressure;

the metal plates preferably extend a few centimeters on either side of the stripped section, the surfaces in these extended portions being set back relative to that of the central portion by a distance approximately equal to one-fifth of the thickness of the polyethylene film.

There will now be described, by way of example only and with reference to the accompanying drawings, a method of butt-jointing, for the purposes of manufacturing a coaxial cable, two tapes of copper or aluminium coated on one or both sides with a film of polyethylene bonded thereto by means of an adhesive, or by treatment of the polyethylene, or by treatment of the metal; after welding together the end portions of the two tapes, the adherent polyethylene film is restored so that the integrity and continuity of its adherence are assured on the insulator and sheath sides.

The operation of butt-jointing the two tapes and restoring the adherent polyethylene film proceeds as follows.

Figure 1:
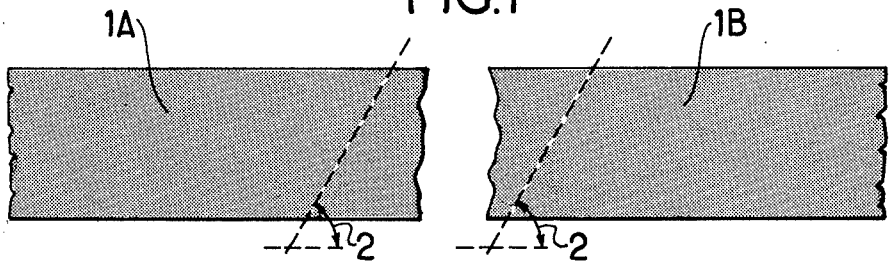
FIG. 1 shows the step of cutting the ends of the tapes.
Figure 2:
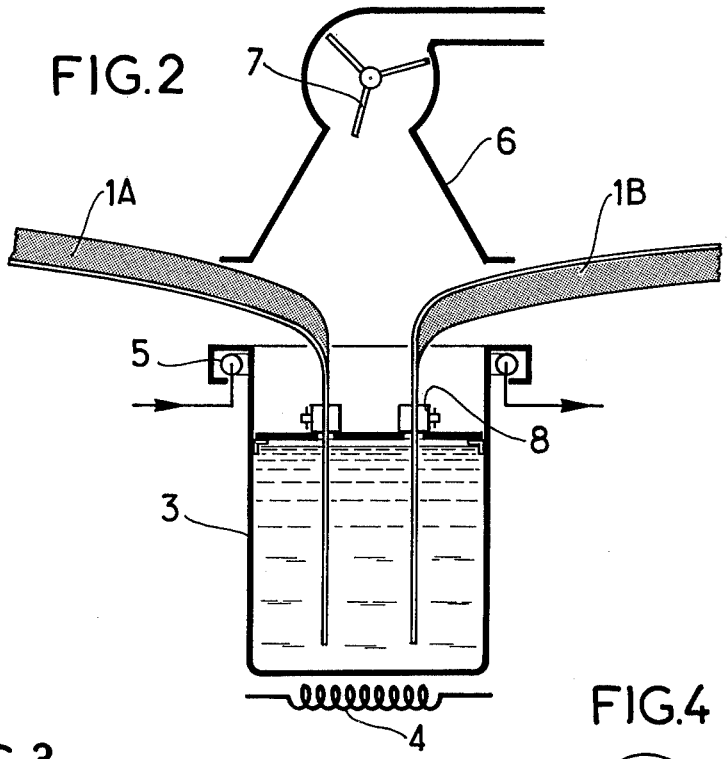
FIG. 2 shows the step of detaching the polyethylene film by immersion in a solvent maintained at its boiling point.

Referring to FIG. 1, the ends of the two tapes 1A, 1B are cut to the welding angle 2, in the same way as for an uncoated metal tape. The angle 2 may be 60°, for example. The ends to be welded together are immersed for between one minute and 90 seconds, according to the nature of the adherent film, in a solvent for detaching the film. Referring to FIG. 2, the solvent is maintained at its boiling point in a temperature-regulated container 3 by means of a heating resistor 4. A coil 5 condenses harmful vapour from the solvent; alternatively, the vapour may be drawn off through a hood 6 by means of a fan 7. The area to be treated for removal of the thermoplastic film is defined by a clamping bar 8.

The solvent used depends on the plastics film. One type of thermoplastic film used for bonding the outer conductor to the insulator or outer sheath is a hybrid film produced by the simultaneous extrusion of high-density polyethylene and ionomer resin, available from Dupont de Nemours under the trade name "Surlyn". A second thermoplastic film which is equally suitable is a film of low-density polyethylene bonded to the metal surface by means of a polyisocyanate or epoxy resin adhesive.

In the first case, allowing for the nature of the intermediate ionomer resin layer, one of the aforementioned solvents tetrahydronaphthalene, decahydronaphthalene, cyclohexane, cyclohexanone and trichlorethylene is used. These swell the thermoplastic film, which is then readily detachable.

Cyclohexanone and decahydronaphthalene are particularly suitable for detaching polyethylene. When the first of these solvents is used, the tapes are preferably immersed for successive periods of 25 and 35 seconds approximately. The second solvent gives good results with three immersions each of approximately 15 seconds. In either case, it is preferable to quickly wipe the tape with a dry rag between successive immersions.

If the thermoplastic film is low-density polyethylene bonded by means of a polyisocyanate or epoxy resin adhesive, the solvent used is dimethylformamide or 2-butanone. These swell and dissolve the adhesive after immersion for five seconds at the boiling point. The polyethylene film is totally detached from the metal.

In the case of a film where adhesion is not produced by means of an adhesive (high-density polyethylene and ionomer resin), the detachment of the film is complete, leaving a perfectly clean metal surface. In the case of a film bonded by means of an adhesive (low-density polyethylene), although the adhesive is softened and of very reduced adherence, it tends to stick to the metal and must be wiped off with a rag.

Figure 3:
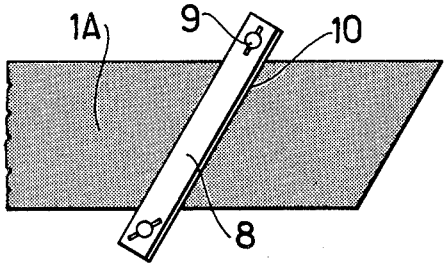
FIG. 3 shows the application of a clamping bar to the end portion of a tape, to define the edge of the area from which the polyethylene film is to be stripped away.
Figure 4:
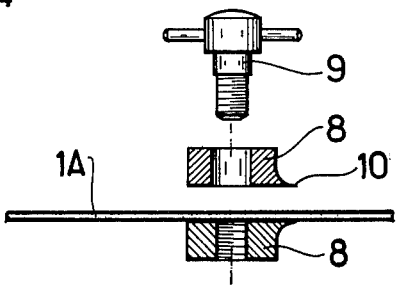
FIG. 4 shows the clamping bar in cross-section, with one of its clamping screws.
Figure 5:
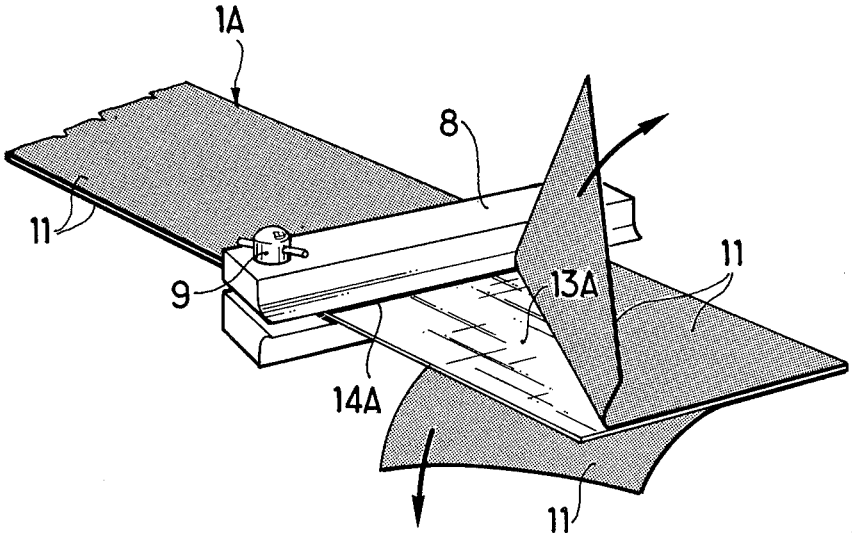
FIG. 5 is a perspective view showing the step of stripping away the polyethylene film after immersion of the end portion of the tape in the solvent.

In either case, if care is taken to limit the length of the tape immersed in the solvent by applying clamping bars 8 to the tape by means of clamping screws 9 (FIGS. 2 and 3), a stop blade being laid flat against the tape, or if the bars 8 are formed with a sharp edge 10 (FIG. 4), the area over which the film is detached is bounded by a sharply defined line, as indicated schematically on FIG. 5 for the film 11.

It may be necessary to briefly immerse the tape again before removing the other polyethylene film in the case of a tape coated on both sides.

Figure 6:
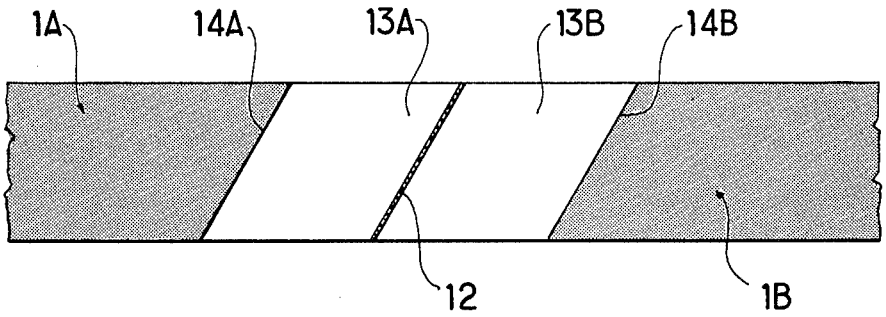
FIG. 6 shows the metal tape after butt-welding of the ends of the two tapes.

The stripped ends of the two tapes are then welded together in the usual manner, preferably being butt-welded by arc welding in an inert gas atmosphere. The tapes may also be welded together with overlapping edges, however. The joint may be also be formed by brazing or by cold pressure welding, or by bonding using a conductive adhesive. The end result is a metal tape with a weld 12 on either side of which are areas 13A, 13B in which the metal is bare, limited by edges 14A, 14B (FIG. 6).

The restoration of the adherent polyethylene film on the stripped portion of the tape on either side of the weld proceeds as follows.

Figure 7:
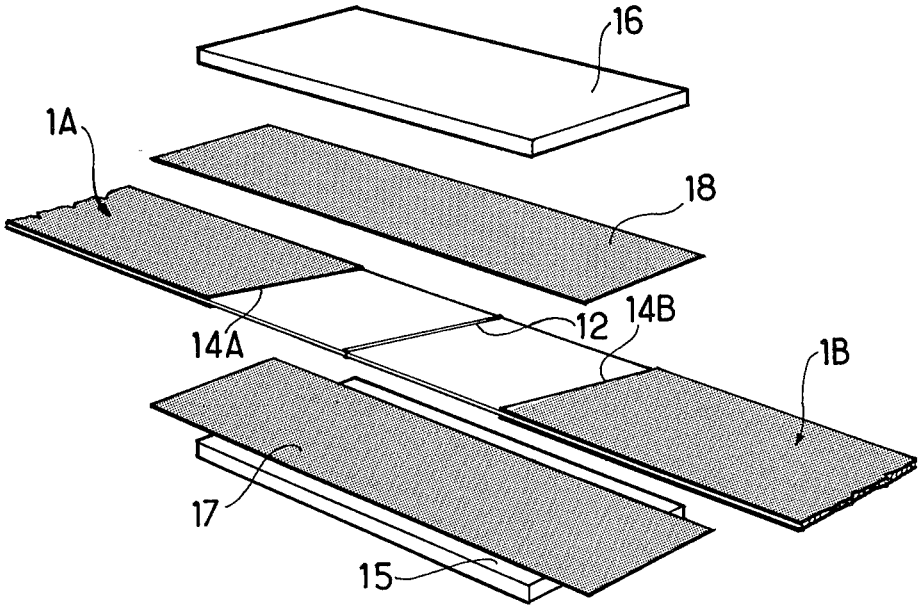
FIG. 7 is an exploded perspective view showing the metal tape, the sheets of high-density polyethylene and the metal plates coated with polytetrafluorethylene which clamp the assembly during the restoration of the plastics film on the metal tape.

Referring to FIG. 7, two thin relatively flexible metal plates 15, 16 are covered with polytetrafluorethylene, a non-stick material. These plates constitute what might be thought of as a mould. On the lower plate is placed a film 17 of polymer material which can be bonded to the plate by the application of heat. In the present instance, relating to the manufacture of electrical cables with a metal outer conductor or screen applied over the electrical insulation, best results are obtained with a film of high-density polyethylene extruded simultaneously with a film of ionomer resin. The film 17 has its adherent side facing upwards. Its thickness will be designated e. On top of the film 17 is placed the welded tape 1A, 1B, the stripped area being correctly centred on the film. On top goes a second film 18 of ionomer resin-polyethylene identical to film 17, but with its adherent surface downwards. The films 17 and 18 should extend beyond the edges 14A, 14B of the stripped area by a few centimeters (15 mm on either side, for example). One of these two films is optional if the tape is coated on only one side.

Figure 8:
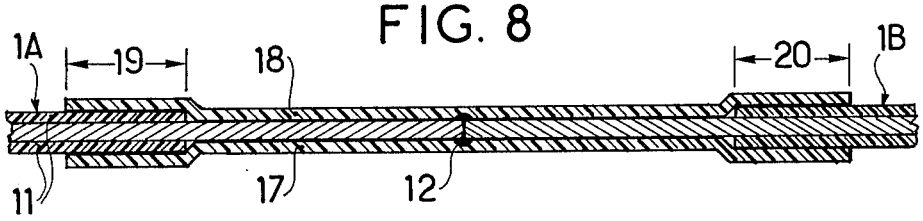
FIG. 8 is a cross-section through the metal tape and polyethylene film.

FIG. 8 is a cross-section through the metal tape, the thermoplastic films and the plates constituting the "mould", showing the areas 19, 20 in which the polyethylene film 18 overlaps the existing plastics film.

Figure 9:
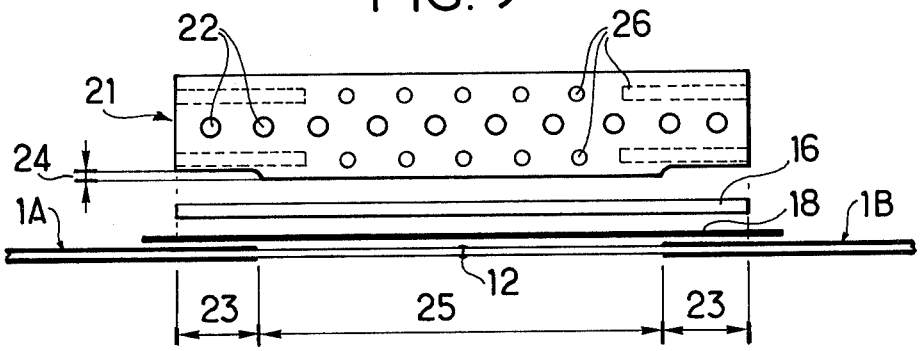
FIG. 9 shows in elevation the metal tape, the polyethylene film, the metal clamping plate and the heated press plate (top side of metal tape only).

The "mould" is then placed between two heated press plates, only one of which (21) is shown in FIG. 9. The press plates incorporate heating resistors inserted in passages 26, and passages 22 for the circulation of cooling water. At their ends, the inside surfaces of the press plates are set back over a length 23 to a depth 24 which is approximately e/5. The resulting length 25 is substantially equal to the length of the stripped section of the metal tape.

The preheated press plates are then urged together in a press with a force of a few tonnes, the heating system being switched into operation so that their temperature rises to approximately 150° C. in one to two minutes.

The heating system is then switched off and the press plates are rapidly cooled by the circulation of water. The metal tape is removed from the mould and the polyethylene film is cleaned up.

As a final step, since in this example the metal tape is to be formed into a non-welded tube to constitute the outer conductor of an electrical cable, the edges are notched.

Although the method and the device for carrying it out which have just been described with reference to the accompanying drawings constitute preferred embodiments of the invention, it will be understood that various modifications may be made thereto without departing from the scope of the invention, certain steps of the process and certain parts of the device being replacable by equivalent steps or parts with the same or similar technical function. Specifically, the detachment of the thermoplastic film using the solvent may be carried out with the solvent at a temperature below its boiling point, by extending the period of immersion. Alternatively, a pressurised container could be used to increase the temperature of the solvent. For applications other than the manufacture of submarine electrical cables a self-adhesive polyethylene film might be sufficient for restoring the adherent polyethylene film.

The polyethylene film applied to the stripped section of the metal tape could be heated by any other source of heat than the electrical resistances described herein.

I claim:

1. A method of butt-jointing tapes of a conductive metal coated on one or both sides with a film of a thermoplastic polymer material selected from the group consisting of a hybrid film of ionomer polymer for bonding to the metal and high-density polyethylene, and a polyisocyanate or epoxy resin adhesive for bonding a film of low-density polyethylene to the metal, as part of a process for manufacturing a composite product involving the continuous feeding of a tape of the metal coated with the thermoplastic polymer film, said method comprising the following steps:

(a) cutting the ends of the two tapes at predetermined matching oblique angles to the feed direction;

(b) detaching the thermoplastic polymer film from the end portion of each tape by immersion for a time interval just sufficient to detach the film in a solvent maintained at its boiling point;

(c) mechanically stripping the detached thermoplastic polymer film from the tape end portions;

(d) welding the end portions of the two tapes together;

(e) covering at least the stripped end portions of the two tapes with a polymer film bondable to the tapes by the application of heat, the portions of the tapes so covered being placed between two metal plates which have at least their surface in contact with the thermoplastic film coated with a heat-resistant material to which the film will not adhere;

(f) placing the metal plates between heated press plates and compressing them to a high pressure; and (g) rapidly cooling the press plates and moving them apart to enable the metal plates to be removed.

2. A method according to claim 1, characterised in that the predetermined angle to the feed direction at which the ends of the two tapes are cut is between 45° and 60°.

3. A method according to claim 1, wherein the tape is coated with a hydrid film of ionomer polymer for bonding to the metal and high-density polyethylene, and the solvent is selected from the group consisting of tetrahydronaphthalene, decahydronaphthalene, cyclohexane, cyclohexanone and trichlorethylene.

4. A method according to claim 3, characterised in that the solvent is cyclohexanone, and that the ends of the tapes are immersed twice, initially for approximately 25 seconds and subsequently for approximately 35 seconds, the two immersions preferably being separated by a wiping stage.

5. A method according to claim 3, characterised in that the solvent is decahydronaphthalene, and in that the tape end portions are immersed three times in succession, for approximately 15 seconds on each occasion.

6. A method according to claim 1, wherein the tape is coated with a film of low-density polyethylene bonded to the metal by a polyisocyanate or epoxy resin adhesive, and wherein the solvent is selected from the group consisting of dimethylformamide and 2-butanone, the tape end portions being immersed for a period which is approximately five seconds.

7. A method according to claim 1, characterised in that the thermoplastic polymer film is stripped off so that the edge of the remaining film is at an angle of between 45° and 90° to the feed direction, the portion removed being limited by a bar clamped across the tape at the aforementioned angle.

8. A method according to claim 1, characterised in that the material which will not bond to the thermoplastic polymer film and which is placed between the metal plate and the hybrid film of high-density polyethylene and ionomer polymer is polytetrafluorethylene.

9. A method according to claim 1, characterised in that the length of the heated press plate applied to the hybrid film and the end portions of the welded tapes is approximately equal to the total stripped length of tape, terminating at each end in a heated section which is spaced from the material which will not bond to the film by a distance which is approximately equal to one-fifth of the thickness of the film.

10. A method according to claim 9, characterised in that the press plates are compressed to a load of a few tons and in that their temperature is maintained at approximately 150° C. for a period of one to two minutes before they are rapidly cooled.

11. A method according to claim 1, characterised in that the polymer film which bonds on application of heat and which is placed on at least the stripped end portions of the two tapes is a hybrid film of high-density polyethylene and ionomer polymer.

* * * * *